United States Patent [19]

Tosches

[11] 3,934,621

[45] Jan. 27, 1976

[54] CARRIER FOR SHUTTLELESS LOOMS

[75] Inventor: Anthony J. Tosches, Milford, Mass.

[73] Assignee: Rockwell International Corporation, Pittsburgh, Pa.

[22] Filed: Mar. 18, 1975

[21] Appl. No.: 559,498

[52] U.S. Cl. ..... 139/122 N

[51] Int. Cl.[2] ..... D03D 47/22

[58] Field of Search ..... 139/122 R, 122 N

[56] References Cited

UNITED STATES PATENTS 3,874,420 4/1975 Cugini ..... 139/122 N

*Primary Examiner*—James Kee Chi

[57] ABSTRACT

An improved carrier for use on a shuttleless loom of the type in which yarn is inserted into the warp shed from a stationary source located outside of the warp and in which yarn is guided by means of cooperating yarn guide surfaces located in the back wall of the carrier, which yarn guide surfaces are laterally offset with respect to each other in a direction transverse to the direction of carrier travel and which vertically overlap each other in a direction normal to the direction of travel of the carrier.

4 Claims, 5 Drawing Figures

CARRIER FOR SHUTTLELESS LOOMS

BACKGROUND OF THE INVENTION

In shuttleless looms, that is, those looms in which weft yarn is supplied from a stationary source located outside the lateral limits of the warp yarns, it is customary to insert each pick of weft by means of a reciprocating inserter or inserters. In the most common shuttleless loom operation a supply of weft is located adjacent the right hand side of the loom and each pick of weft is drawn from the source and inserted into the shed formed between the warp yarns. The insertion itself is effected by means of an inserter carrier which is moved into and from the shed by means of a reciprocating inserter. In this usual form the inserter carrier is met at approximately the center of the warp shed by an extending carrier which grasps the weft being inserted and draws it to the other side of the loom. The extending carrier is moved into and out of the shed by means of a reciprocating inserter in the same manner in which the inserter carrier is moved.

There are two basic weft insertion methods that are used with looms of the type mentioned above. These weft insertion methods are the Gabler and Dewas methods and are frequently referred to as the "hair pin" and "gripper" methods respectively. In the Gabler insertion method a weft yarn end is held clamped outside of the selvedge after cutting and the inserting carrier then pulls a quantity of yarn from the yarn package so that a loop of yarn is initially formed in the warp shed. After a predetermined length of time, the clamped end is released so that the extending carrier can continue to draw the looped yarn to the other side of the loom. By way of contrast the Dewas system utilizes inserting and extending carriers in which the end of the yarn is gripped by the inserting carrier and then this same gripped end is transferred to the extending carrier and drawn on to the other side of the warp.

With the development of multi-color looms the various yarns have been frequently guided by a slot located in the rear wall of the carrier, this slot beginning in the upper surface of the rear wall and extending downwardly toward the bottom of the carrier and rearwardly toward the end of the carrier which is attached to the inserter member. In addition a small yarn guiding or trapping hook was used which extended generally upwardly and rearwardly with respect to the back surface of the rear wall to aid in maintaining the yarn within the guide slot.

When weaving certain types of fabrics, particularly that of high sley, such as poplin or broad cloth is not uncommon for some warp yarns to knit or in other words to fully close during harness shedding. Unfavorable conditons of this nature can be attributed to warp yarn preparation wherein slubs and other impurities are caused to adhere to the warp yarns during the preparatory stages. Imperfections of this nature very often cause certain warp yarns to knit or stitch together and present an obstructed shed into which the filling carriers enter. Additionally one or more of the warp yarns might be improperly tensioned permitting it to hang down into that area of the shed where the carrier must normally travel. In many cases filling carriers which enter sheds of these types will cut the warp yarns obstructing their path of travel and cause interruption of loom operation. In addition, carriers of the type referred to above that are used for multi-color weaving tend to be structurally weaker than those normally used in single color operation due to the fact that more of the material has been removed from the back wall to accommodate yarn reception and guiding into the carrier. In many cases actual breaking of carriers has occurred during operation and this, like yarn breakage causes loom interruption.

SUMMARY OF THE INVENTION

It is a principle object of this invention to provide an improved carrier which can be used in multi-color weaving operations and which is structurally stronger than carriers which have in the past been used for the insertion of weft yarn from a plurality of yarn packages.

Another object of this invention is to provide an improved carrier which will substantially eliminate the breakage of warp yarns that might for some reason be in the path of travel of the carrier during its travel within the warp shed.

Other objects and advantages of this invention will be in part obvious and in part explained by reference to the accompanying specification and drawings in which:

DESCRIPTION OF THE INVENTION

Figure 1:
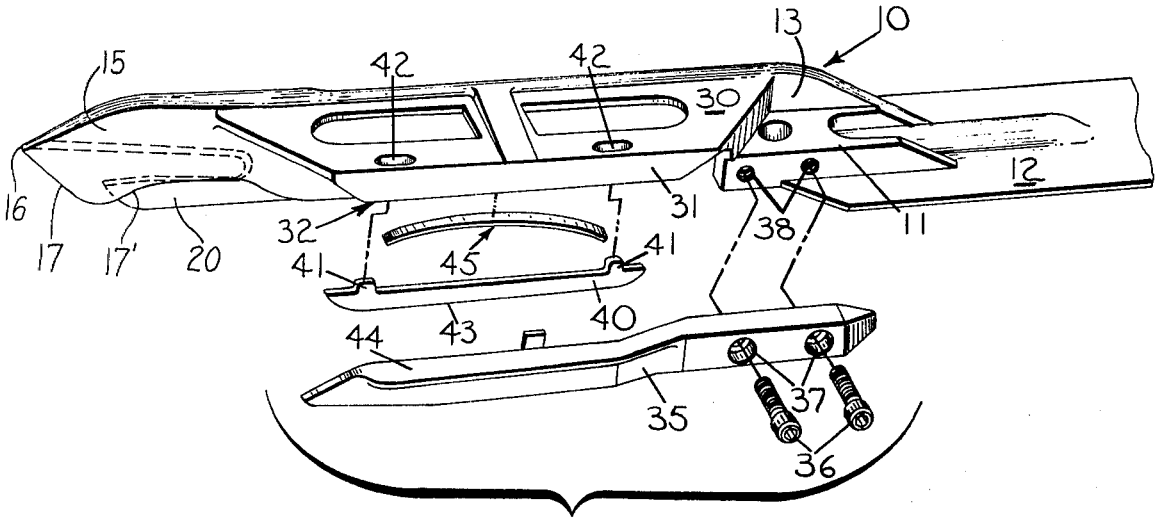
FIG. 1 is an enlarged, slotted perspective view of a carrier according to this invention.

For a more complete understanding of the invention, reference is made to the drawings and specifically to FIG. 1. In this figure, the numeral 10 indicates generally the improved carrier of this invention. The carrier is comprised of a main body portion 11 which is shown as being attached or secured to the inserter 12. The inserter 12 is hereshown as a flat flexible tape, normally constructed of flexible steel, which is wrapped about a reciprocating drive wheel (not shown) located at the side of the loom. To move the carrier 10 into and from the warp shed the tape wheel is operated to effect reciprocation of the carrier.

Figure 2:
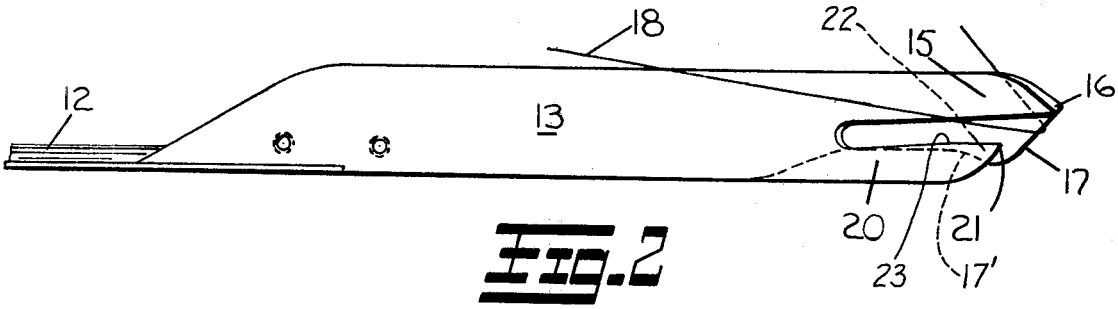
FIG. 2 is a side elevation of the improved carrier looking at the rearmost surface of the rear wall.

The carrier additionally comprises a rear wall 13, see FIG. 2, which extends outwardly from the main body 11 in a direction away from the inserter 12. Generally speaking the long dimension of the rear wall 13 is disposed substantially at right angles with respect to the wide cross dimension of the inserter tape 12. This angular relationship is not critical but is effective in permitting orientation of the operating part of the carrier so that maximum operating efficiency can be obtained. At this point it should further be explained that while a flat, tape-like inserter has been shown and referred to, the particular type of inserter element used to drive the carrier 10 is not critical to this invention.

Rear wall 13 includes an upper extension 15 that extends outwardly from the rear wall to a terminus 16. The upper extension 15 is shown as being an integral part of the rear wall 13 and, while this is a preferred construction, it should be noted that extension 15 could be constructed as a separate element if circumstances made this type of construction preferable. The upper extension 15 also has a generally downwardly facing yarn engaging surface 17 that is the first surface to make contact with the yarn, indicated by numeral 18, to direct it downwardly and inwardly in the direction of inserter 12. As shown in the drawings the surface 17 extends initially downwardly and inwardly from the terminus 16 of extension 15 in a direction toward the main body 11 or tape 12 and then upwardly and inwardly as at 17' in the direction toward main body 11 along a portion of the remainder of the yarn engaging surface.

To provide a cooperating means to insure positive yarn engagement, the improved carrier further comprises a lower extension 20 that extends from rear wall 13 in the same direction as upper extension 15 except that extension 20 ends in a terminus 21 that is located closer to the main body 11 than is the upper terminus 16. The reason for terminus 21 being located inwardly from terminus 16 is to provide an opportunity for yarn 18 to slide down the surface 17 and enter into the area 22 that is formed between upper extension 15 and lower extension 20. It further can be seen that lower extension 20 has a generally upwardly facing yarn engaging surface 23 so that the yarn 18 when entering into the area 22 will make contact with both downwardly facing surface 17 and with upwardly facing surface 23.

Figure 3:
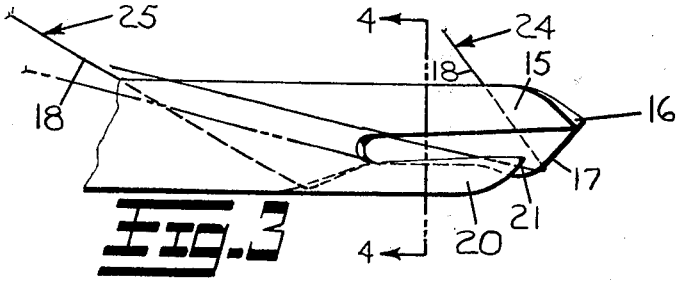
FIG. 3 is a side elevation with parts broken away showing the manner in which yarn is received by the carrier.
Figure 4:
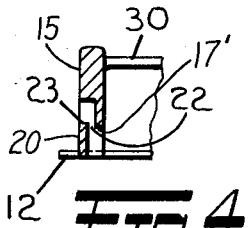
FIG. 4 is a section throughout which the rear wall of the shuttle.

As best seen in FIG. 4 of the drawings, the yarn engaging surface of upper extension 15 and of lower extension 20 are laterally offset with respect to each other in a direction transverse to the direction of inserter travel and, as seen most clearly in FIGS. 2 and 3, the surfaces are vertically overlapped in a direction normal to the direction of travel of the inserter. The purpose for this physical relationship is of course to prove for the area 22 through which the yarn will travel when engaged by the carrier. Generally speaking, the initial contact is made by the carrier in approximately the position of yarn 18 shown in FIG. 2. Thereafter, the yarn moves to the positions indicated by numerals 24 and 25 in FIG. 3, 25 being the final fully inserted condition of the yarn as it is being moved into the warp shed.

Carrier 10 has an upper wall 30 that extends forwardly from rear wall 13 and terminates in a comparatively short downwardly extending front wall 31 whose lower edge 32 is located physically above the lower edge of rear wall 13.

To provide means for gripping the yarn to be inserted into the shed, carrier 10 includes a yarn gripper finger 35 that is secured to main body 11 by means of threaded fasteners 36 that are mounted through holes 37 and received into the threaded openings 38 in the side of main body 11. Actual clamping of the yarn is accomplished by means of a yarn clamping element 40 that has small tabs of 41 that extend through the elongated or slotted openings 42 in the upper wall 30. The lower surface 43 of yarn clamping element 40 rests against the upper surface 44 of yarn guide finger 35. A biasing force to urge clamping element 40 into contact with surface 44 of finger 35 is developed by means of the small leaf spring 45 that is mounted between the tabs 41 and the lower surface of upper wall 30 and the inner surface of the front wall 31.

Figure 5:
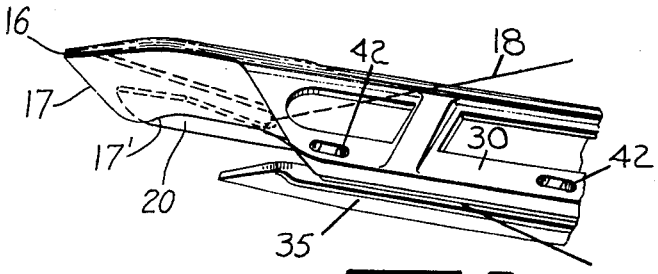
FIG. 5 is a partial perspective view showing the manner in which yarn is received within the assembled gripper.

In operation, when the carrier 10 is moved from its position outside of the warp shed into the warp shed it will engage the end of the supplied weft yarn and grip it in the fashion shown in FIGS. 2 and 5 of the drawings. Since this carrier has no yarn engaging, directing tabs that extend out beyond the normal limits of the carrier body it will reduce the frequency with which improperly stitched or positioned warp yarns might be broken. Additionally the carrier is capable of inserting yarn from a plurality of yarn sources without resorting to a configuration that results in a carrier of comparatively weak mechanical construction.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. An improved carrier for inserting weft yarn into the shed formed between warp yarns on a loom of the type in which the weft yarn is supplied from a source outside of the warp and is inserted into the shed by a carrier which is attached to a reciprocating carrier, said improved carrier comprising:

1 a main body portion for attachment to the inserter
2 a rear wall extending outwardly from said main body in a direction away from the inserter
3 an upper extension extending outwardly from said rear wall to a terminus and having a generally downwardly facing yarn engaging surface,
4 a lower extension extending outwardly from said rear wall to a terminus and having a generally upwardly facing yarn engaging surface, and
5 said yarn engaging surfaces of said upper and lower extensions being
  a. laterally offset with respect to each other in a direction transverse to the direction of inserter travel and
  b. vertically overlapping in a direction normal to the directon of inserter travel.

2. An improved carrier as defined in cliam 1 wherein the terminus of said lower extension is located closer to said main body than is the terminus of said upper extension.

3. An improved carrier as defined in claim 1 wherein said yarn engaging surface of said upper extension extends initially downwardly and inwardly from the terminus of said extension in the direction toward said main body and then upwardly and inwardly in the direction toward said main body along at least a portion of the remainder of said surface.

4. An improved carrier as defined in claim 1 wherein said upper and lower extensions are formed as integral extensions of said main body.

* * * * *